US005512001A

United States Patent [19]

Kent et al.

[11] Patent Number: 5,512,001

[45] Date of Patent: Apr. 30, 1996

[54] TOY VEHICLE

[75] Inventors: Michael Kent, Barrington; Thomas P. Hamilton, Cranston; Stephen Schwartz, Providence; Henry Sharpe, III, Saunderstown; Ralph Beckman, Providence; Bryan Thurston, Johnston, all of R.I.

[73] Assignees: Stephen Schwartz Design; Design Lab, both of Providence, R.I.

[21] Appl. No.: 383,117

[22] Filed: Feb. 3, 1995

[51] Int. Cl.[6] ..... A63H 17/34; A63H 33/28

[52] U.S. Cl. ..... 446/25; 446/409; 446/434

[58] Field of Search ..... 446/25, 24, 409, 446/410, 434

[56] References Cited

U.S. PATENT DOCUMENTS

| | | | |
|---|---|---|---|
| 1,287,768 | 12/1918 | Schanschieff . | |
| 1,608,142 | 11/1926 | Stephenson . | |
| 1,671,132 | 5/1928 | Shoudy . | |
| 1,944,821 | 1/1934 | Blaise . | |
| 1,994,932 | 3/1935 | Vidal . | |
| 2,461,664 | 2/1949 | Smith | 446/25 |
| 2,995,866 | 8/1961 | Johnson . | |
| 3,003,279 | 10/1961 | Bonanno . | |
| 3,142,132 | 7/1964 | Johnson . | |
| 3,255,551 | 6/1966 | Scheihing . | |
| 3,891,826 | 6/1975 | Seuthe et al. . | |
| 4,303,397 | 12/1981 | Swiatosz . | |
| 4,332,101 | 6/1982 | Tomita . | |
| 4,374,038 | 2/1983 | Tamura . | |
| 4,741,717 | 5/1988 | Wolf | 446/24 |
| 4,946,416 | 8/1990 | Stern et al. | 446/409 |
| 5,069,230 | 12/1991 | Green . | |
| 5,361,705 | 11/1994 | Powell | 104/60 |

*Primary Examiner*—Mickey Yu
*Attorney, Agent, or Firm*—Kurt R. Benson

[57] ABSTRACT

A toy vehicle includes a sound generating mechanism for generating realistic vehicle engine sound and a smoke generating mechanism for generating simulated smoke vapors. The sound generating mechanism and the smoke generating mechanism are simultaneously actuatable by moving an accessory, such as a spoiler, on a cab portion of the vehicle.

6 Claims, 5 Drawing Sheets

TOY VEHICLE

BACKGROUND AND SUMMARY OF THE INVENTION

The instant invention relates to toy vehicles and more particularly to a toy vehicle which includes smoke and sound generating mechanisms.

It is widely recognized that toy vehicles which are adapted to closely simulate full size vehicles have relatively high levels of appeal among children. Further, this has been found to be particularly true with respect to heavy duty industrial vehicles, such as trucks and construction vehicles. It has been further found that vehicles which are capable of producing realistic sound effects and/or other realistic action effects frequently have increased levels of appeal. For example, it has generally been found that vehicles which are capable of producing realistic engine sounds frequently have relatively high levels of appeal. It has also been found that vehicles which are capable of producing other realistic effects, such as realistic simulated engine smoke, frequently have relatively high levels of appeal.

Toy vehicles representing the closest prior art to the subject invention of which the applicant is aware are disclosed in the U.S. patents to Schanschieff, U.S. Pat. No. 1,287,768; Stephenson, U.S. Pat. No. 1,608,142; Shoudy, U.S. Pat. No. 1,671,132; Smith, U.S. Pat. No. 2,461,664; Johnson, U.S. Pat. No. 2,995,866; Bonanno, U.S. Pat. No. 3,003,279; Johnson, U.S. Pat. No. 3,142,132; and Stern et al. U.S. Pat. No. 4,946,416. However, since the vehicles disclosed in these references employ significantly different types of actuating mechanisms from the one found in the vehicle of the instant invention, they are believed to be of only general interest with respect thereto.

The toy vehicle of the instant invention is preferably embodied as a heavy duty industrial truck, such as a tractor trailer truck, and it includes a vehicle body and chassis assembly which is preferably adapted to resemble the body and chassis of a tractor trailer truck. The vehicle includes a plurality of wheels for movably supporting it on a supporting surface and a movable vehicle related accessory which is independent of the movement of the vehicle on a supporting surface. The vehicle accessory is preferably formed in the configuration of a spoiler, and it is preferably mounted on a cab portion of the vehicle and chassis assembly. Further, the accessory is preferably pivotable between first and second positions on the body and chassis assembly, and it is preferably biased toward the first position thereof. The vehicle further includes a sound generating mechanism on the body and chassis assembly which is responsive to movement of the accessory for generating engine sounds related to the vehicle, and a smoke generating mechanism which is responsive to movement of the same accessory for producing a quantity of simulated smoke. Further, the sound generating mechanism is preferably adapted so that as the accessory is moved from the first position thereof toward the second position thereof, the frequency of the engine sounds produced is increased, and so that as the accessory is moved from the second position thereof toward the first position thereof, the frequency of the engine sounds is decreased.

Accordingly, in its preferred embodiment the instant invention comprises a tractor trailer truck having a spoiler which is pivotably mounted on a cab portion thereof. The spoiler is pivotable between first and second positions on the cab portion, although it is biased toward the first position thereof. Further, the vehicle includes sound generating and smoke producing mechanisms which are actuated as the spoiler is pivoted from the first position thereof toward the second position thereof. Still further, the frequency of the engine sounds produced by the sound generating mechanism is increased as the spoiler is pivoted toward the second position thereof and decreased as the spoiler is pivoted toward the first position thereof. As a result, when the spoiler is pivoted toward the second position thereof, the sound generating mechanism produces sounds corresponding to those of an accelerating engine and the smoke producing mechanism produces a puff of smoke. On the other hand, when the spoiler is returned to the first position thereof, the sound generating mechanism produces sounds which resemble those of an idling engine, and the smoke generating mechanism produces only a minimal quantity of smoke.

Accordingly, it is a primary object of the instant invention to provide an effective and amusing simulated vehicle which is capable of producing realistic vehicle sounds and simulated vehicle smoke.

Another object of the instant invention is to provide a toy tractor trailer truck having a spoiler thereon which is operative for actuating a sound generating mechanism and a smoke generating mechanism.

An even still further object of the instant invention is to provide a toy vehicle having a spoiler thereon which is pivotable for increasing the frequency of engine sounds produced from the vehicle.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
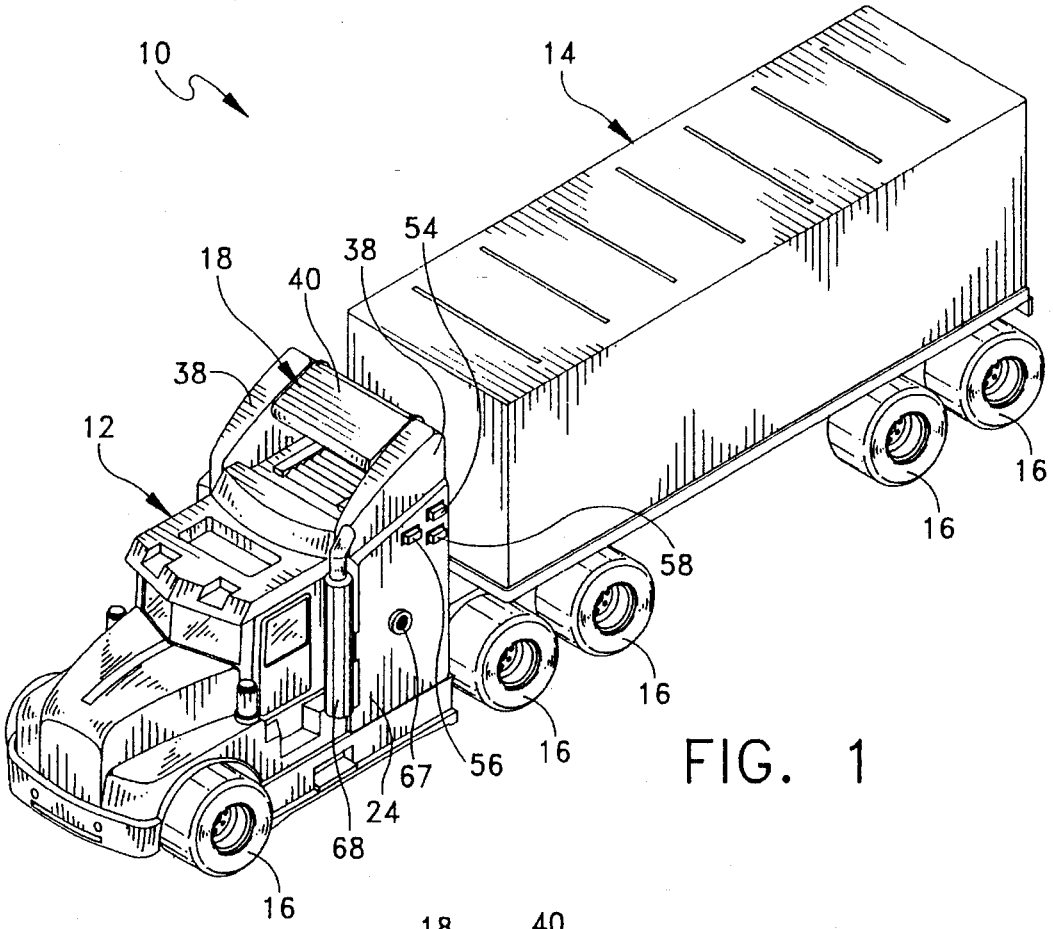
FIG. 1 is a perspective view of the toy vehicle of the instant invention.
Figure 2:
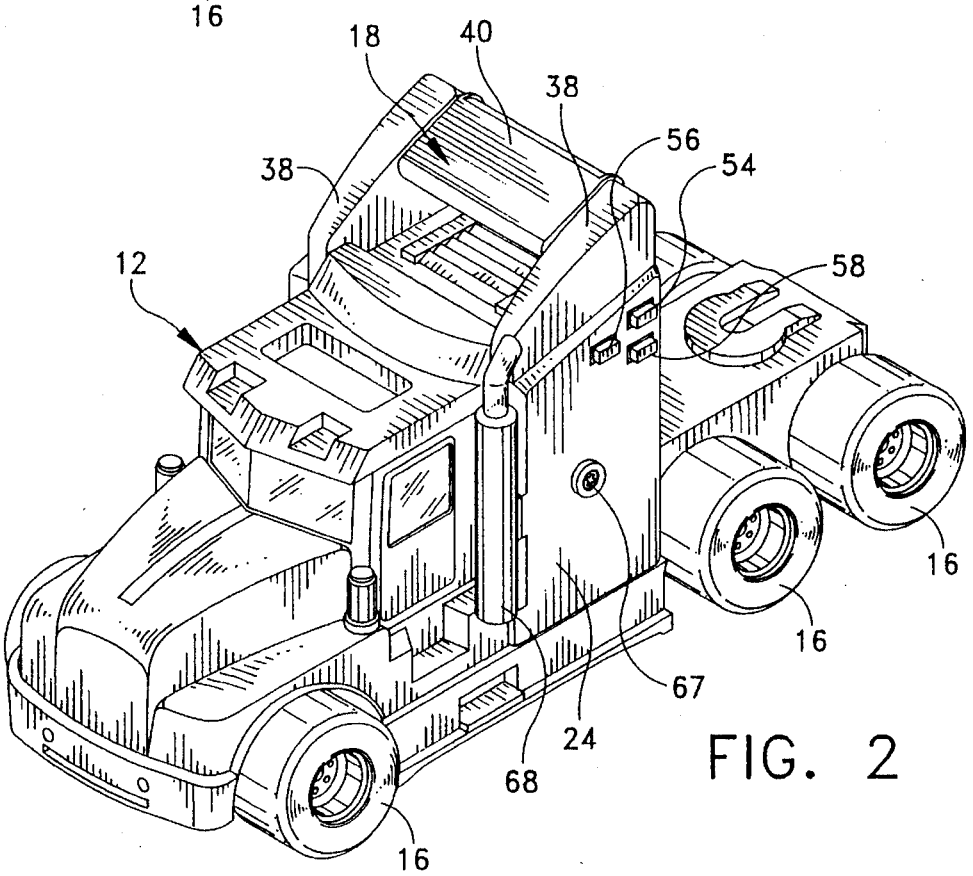
FIG. 2 is a perspective view of the cab portion thereof.
Figure 3:
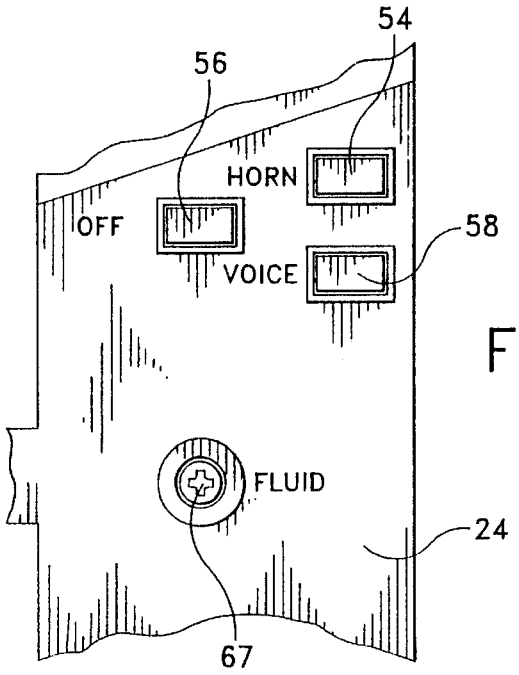
FIG. 3 is a fragmentary side elevational view of the control panel portion of the cab portion.
Figure 4:
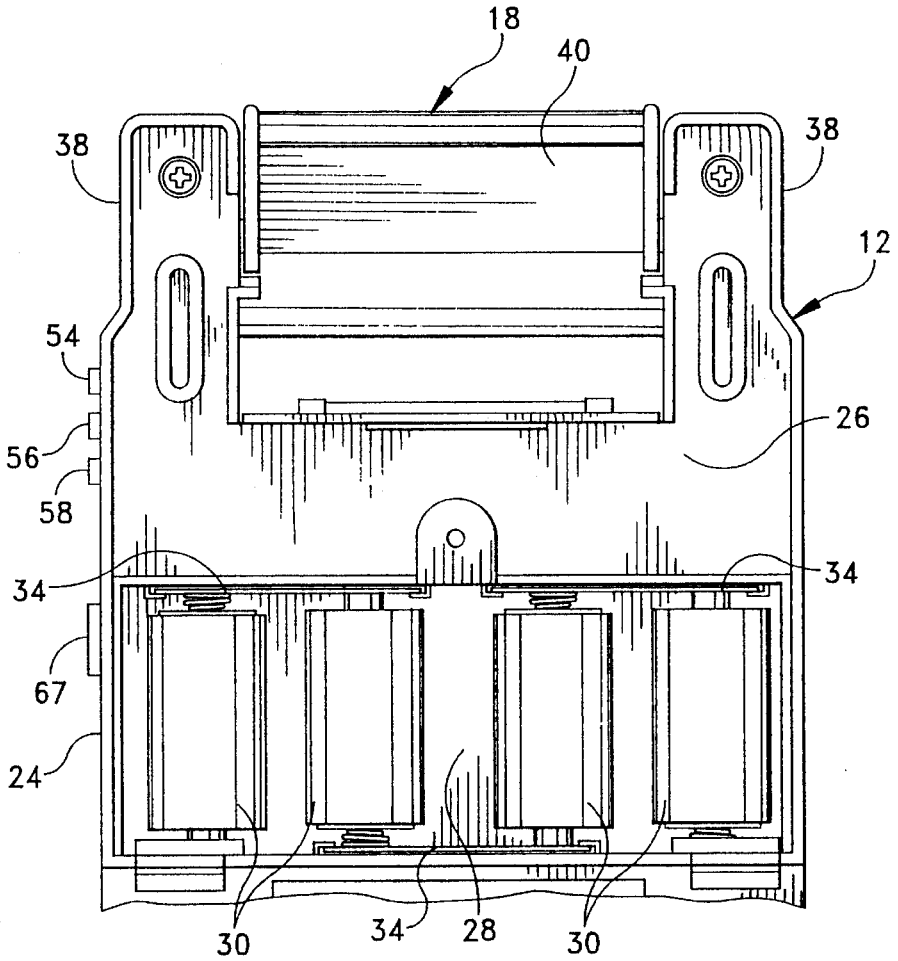
FIG. 4 is a rear elevational view of the upper rear portion of the cab portion with the battery cover removed.
Figure 5:
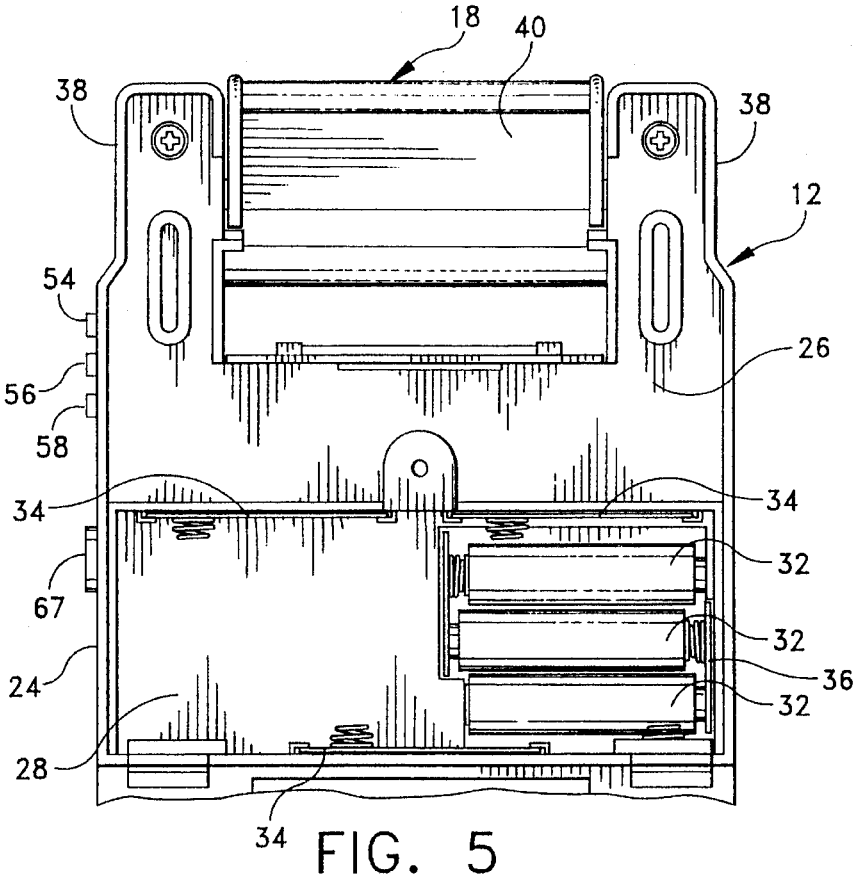
FIG. 5 is a similar view with one set of the batteries removed.
Figure 6:
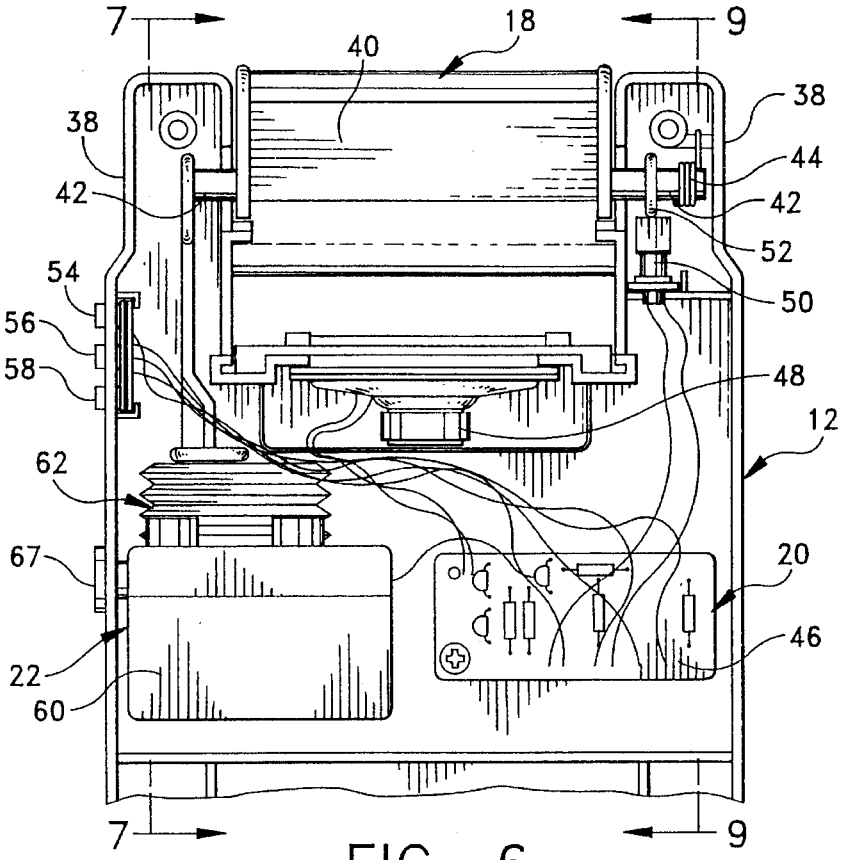
FIG. 6 is a rear elevational view of the cab portion with the rear battery compartment and housing portion removed.
Figure 7:
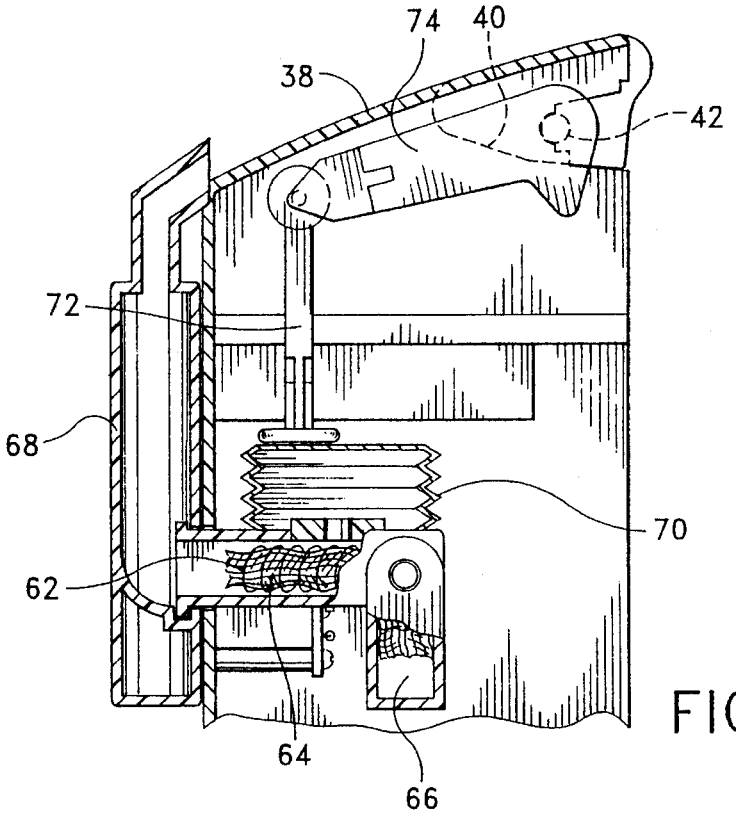
FIG. 7 is a sectional view taken along line 7—7 in FIG. 6.
Figure 8:
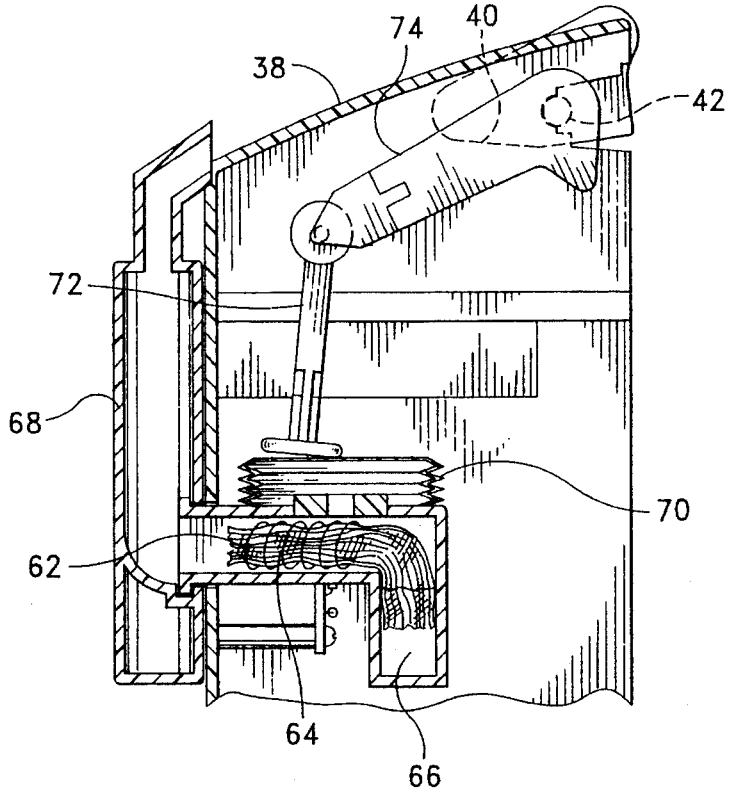
FIG. 8 is a similar view with the spoiler in the second position thereof.
Figure 9:
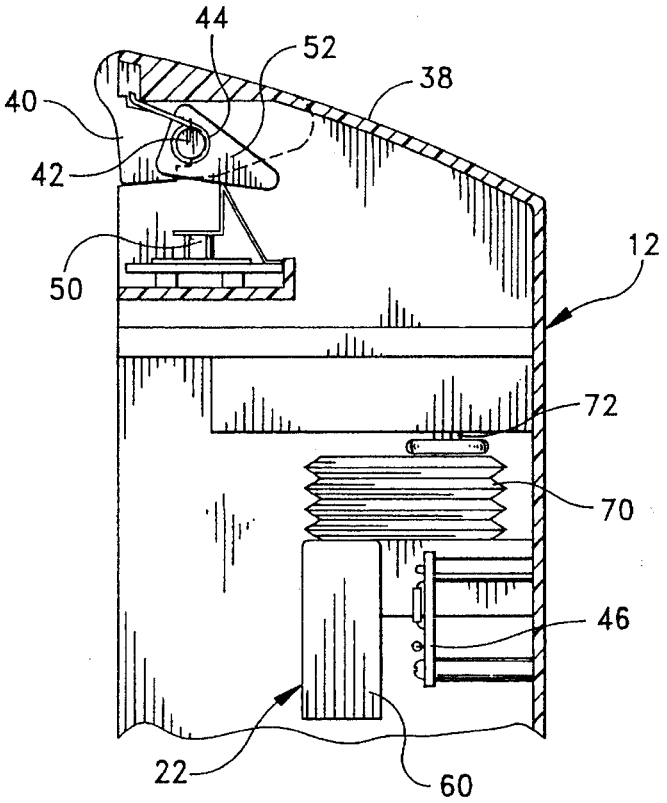
FIG. 9 is a sectional view taken along line 9—9 in FIG. 6.
Figure 10:
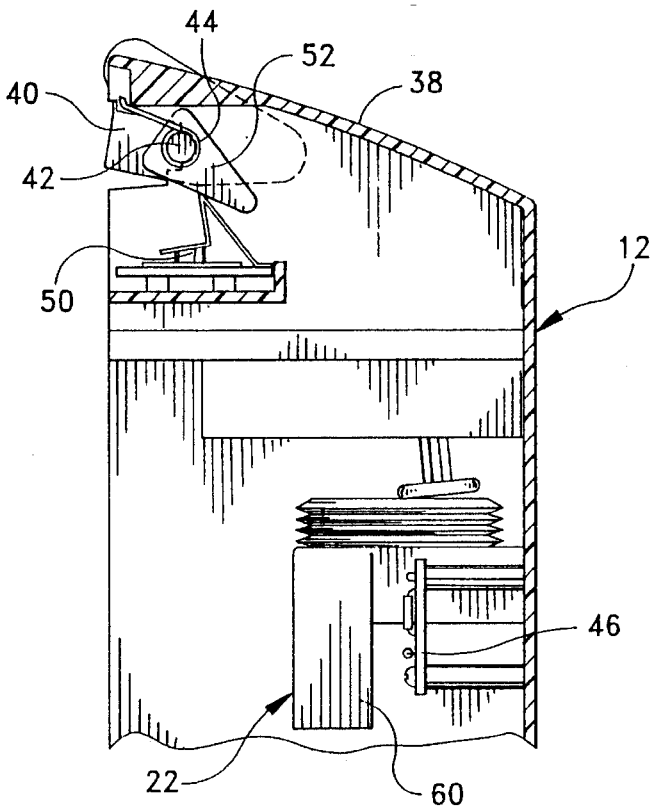
FIG. 10 is a similar view with the spoiler in the second position thereof.

Referring now to the drawings, the toy vehicle of the instant invention is illustrated in FIGS. 1–10 and generally indicated at 10 in FIG. 1. The toy vehicle 10 comprises a vehicle body and chassis assembly including a cab portion generally indicated at 12 and a trailer portion generally indicated at 14. The cab portion 12 and the trailer portion 14 are movably supported on wheels 16, and they are detachably connected in a conventional manner. An accessory comprising a spoiler assembly generally indicated at 18 is mounted on the cab portion 12, and contained within the cab portion 12 are a sound generating mechanism generally indicated at 20- and a smoke generating mechanism generally indicated at 22. The vehicle 10 is adapted so that the spoiler assembly 18 can be manipulated for actuating the sound producing mechanism 20 to produce related vehicle engine sounds and for simultaneously actuating the smoke generating mechanism 22 for producing simulated vehicle smoke.

The cab portion 12 is adapted to resemble the cab portion of a tractor trailer truck, although it includes a side control panel 24 having a plurality of switches thereon for controlling the operation of the sound generating mechanism 20 and the smoke generating mechanism 22. The cab portion 12 further includes a rear panel 26, including a battery compartment 28 containing a plurality of first batteries 30 and a plurality of second batteries 32. The batteries 30 are electrically connected in series relation through a series of connector plates 34 to provide a first power source for powering the smoke generating mechanism 22, and the second batteries 32 are electrically connected in series relation through a series of connector plates 36 to provide a second power source for powering the sound generating mechanism 20.

The spoiler assembly 18 comprises a pair of side mounting sections 38 which are integrally formed with the cab portion 12 and a pivotable spoiler element 40. The spoiler element 40 includes mounting shaft portions 42 (see FIG. 6), and it is biased to the upwardly pivoted position illustrated in FIGS. 1 and 2 with a spring 42. The spoiler element 40 is, however, pivotable from the first or upwardly pivoted position illustrated in FIGS. 1, 2, 7 and 9 to the second or downwardly pivoted position illustrated in FIGS. 8 and 10.

The sound generating mechanism 20 includes a digital sound generating circuit 46, a speaker 48, and a control switch 50. The digital sound generating circuit 46 comprises a conventional digital circuit which is operative for reproducing prerecorded sounds in a digital format. The sound generating circuit 46 is connected to the speaker 48 for reproducing output signals from the circuit 46 in the form of audible sound. As herein embodied, the sound generating circuit 46 is adapted for reproducing vehicle engine sounds, vehicle horn sounds, and human voice sounds through the speaker 48, although obviously the circuit 46 could be adapted in a conventional manner to reproduce various other sounds as well. The switch 50 is electrically connected to the sound generating circuit 46, and it is operative for changing the frequency of the engine sounds reproduced through the mechanism 20 as the spoiler element 40 is pivoted. In this regard, an eccentric cam element 52 is provided adjacent the switch 50 on one of the pivot shafts 42. The cam element 52 is engageable with the switch 50 to depress the switch 50 as the spoiler element 40 is pivoted downwardly toward the second position thereof. The circuit 46 is adapted so that it is responsive to the switch 50 for increasing the frequency of the engine sounds produced from the sound unit 20 when the switch 50 is depressed. Accordingly, as the spoiler element 40 is pivoted downwardly toward the second position thereof, the frequency of the engine sounds reproduced from the sound unit 20 is increased to simulate engine acceleration. Further, the sound unit 20 is adapted so that if it is initially in an "off" condition, downward pivotal movement of the spoiler element 40 causes the sound unit 20 to be actuated and to then produce engine sounds which are increased in frequency as the spoiler element 40 is pivoted. The sound unit 20 also includes "horn", "off", and "voice" switches 54, 56 and 58, respectively, which are mounted on the control panel 24. The sound unit 20 is adapted so that the horn and voice switches 54 and 58 are operative for causing the sound unit 46 to produce "horn" and "voice" sounds, respectively, and for thereafter operating the sound unit 46 in an "on" condition for a predetermined period of time during which engine idling sounds are produced. The "off" switch 56 is operative for deenergizing the sound unit 20.

The smoke producing mechanism 22 per se is basically of conventional construction and it includes a smoke module 60 and a bellows assembly generally indicated at 62. The smoke module 60 comprises a conventional smoke generating unit which is operative for producing vapors which simulate engine exhaust smoke. Specifically, the smoke module 60 contains a nickel chromium wire 62 which is wrapped around a fiberglass wick 64. The wick 64 extends into a fluid reservoir 66. Further, the wire 62 is electrically connected to the first power supply provided by the batteries 30, although the wire 62 is actually connected to the batteries 30 through a switch contained in the sound producing unit 20. In any event, a conventional vaporizable liquid, such as propylene glycol is provided in the reservoir 66 through a filling port 68. The wick 64 is operative for carrying the vaporizable liquid from the reservoir area 66 to the wire 62, and the wire 62 is adapted so that it is energizable with the first power supply for heating the wire 62 to sufficient temperature to vaporize the vaporizable liquid. As a result, during operation of the smoke generating mechanism 22, vapors are passed outwardly into a simulated exhaust pipe 68 on the side of the cab portion 12.

The bellows assembly 62 is mounted on top of the smoke module 60, and it comprises a compressible bellows element 70, a compression arm 72 and a linkage arm 74. The linkage arm 74 extends integrally from one of the pivotal mounting shafts 42 in the spoiler assembly 18, and the compression arm 72 is pivotally attached to the linkage arm 74 so that it extends downwardly to the bellows element 70. Accordingly, as the spoiler element 40 is pivoted downwardly, the linkage arm 74 moves the compression arm 72 downwardly to compress the bellows element 70. This causes a momentary blast of air to be passed into the smoke module 60 whereby any vaporized fluid in the module 60 is carried upwardly and out through the exhaust pipe 68.

Accordingly, during use and operation of the vehicle 10, the spoiler element 40 is pivotable downwardly on the cab portion 12 to actuate the sound generating unit 20 and the smoke generating unit 22. In this regard, as the spoiler element is initially pivoted downwardly, both the sound generating unit 20 and the smoke generating unit 22 are energized. This causes engine sounds to be produced through the speaker 48, and as the spoiler element 40 is pivoted further downwardly, the frequency of the engine sounds produced is increased to simulate engine acceleration. As the spoiler element 40 is then released, it is returned to an upwardly pivoted position by the spring 44 causing the frequency of the sounds produced from the sound generating unit 20 to be decreased so that they simulate the sounds of an idling engine. The sound generating unit 20 can also be operated for producing voice sounds by operating the voice button 58 or for producing horn sounds by pressing the horn button 54. The sound generating unit can be deenergized by depressing the "off" button 56. In any event, whenever the sound generating unit 20 is energized, the smoke generating unit 22 is also in an energized state, although it normally takes a few seconds for the nickel chromium wire 62 to reach a temperature sufficient to produce smoke from the smoke generating unit 60. However, once the wire 62 has been sufficiently heated, smoke is passed outwardly from the smoke generating unit 22 through the exhaust pipe 68. Thereafter, when the spoiler 40 is pivoted downwardly toward the second position thereof, the bellows assembly 62 causes a blast of air to be passed through the smoke generating unit 60 so that a puff of vapors is emitted from the smoke stack 68.

It is seen, therefore, that the instant invention provides a unique and exciting toy vehicle. The vehicle 10 is operative by manipulating the spoiler accessory 40 to produce both vehicle sounds and smoke simulating vapors. Hence, it is seen that the vehicle 10 is highly realistic in its operation, and that it represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy vehicle comprising:

a miniature tractor trailer truck body and chassis including a cab portion and an exhaust pipe extending upwardly along said cab portion;

means for movably supporting said body and chassis on a supporting surface;

a vehicle related accessory movably mounted on the exterior of said body and chassis for movement between first and second positions thereon, the movement of said accessory being independent of the movement of said body and chassis on said supporting surface;

sound generating means on said body and chassis responsive to movement of said accessory for generating engine sounds related to said vehicle; and smoke producing means for discharging an induced puff of simulated smoke through said exhaust pipe in response to movement of said accessory on said body and chassis, said smoke producing means including a bellows for inducing the discharge of simulated smoke through said exhaust pipe.

2. A toy vehicle comprising:

a vehicle body and chassis;

means for movably supporting said body and chassis on a supporting surface;

a spoiler mounted on said body and chassis for movement between first and second positions thereon, the movement of said spoiler being independent of the movement of said body and chassis on said supporting surface;

sound generating means on said body and chassis responsive to movement of said spoiler on said body and chassis for generating engine sounds related to said vehicle; and smoke producing means on said body and chassis for producing a puff of simulated smoke in response to movement of said spoiler on said body and chassis.

3. In the vehicle of claim 1, said body and chassis comprising a miniature tractor trailer truck body and chassis and including a truck cab portion, said spoiler being mounted on said truck cab portion, said spoiler being pivotable downwardly for movement from a first position thereof to a second position thereof.

4. In the vehicle of claim 1, said sound generating means being adapted so that the engine sounds produced therefrom increase in frequency when said spoiler is moved from the first position thereof to the second position thereof and decrease in frequency when said spoiler is moved from the second position thereof to the first position thereof.

5. The vehicle of claim 3 further comprising means biasing said spoiler toward the first position thereof.

6. In the vehicle of claim 5, said sound generating means being adapted so that the engine sounds produced therefrom increase in frequency when said spoiler is moved from the first position thereof to the second position thereof and decrease in frequency when said spoiler is moved from the second position thereof to the first position thereof.

* * * * *